US005383293A

United States Patent [19]

Royal

[11] Patent Number: 5,383,293

[45] Date of Patent: Jan. 24, 1995

[54] PICTURE FRAME ARRANGEMENT

[76] Inventor: John D. Royal, 606 Old Jersey, College Station, Tex. 77840

[21] Appl. No.: 134,056

[22] Filed: Oct. 12, 1993

Related U.S. Application Data

[62] Division of Ser. No. 935,791, Aug. 27, 1992, abandoned.

[51] Int. Cl.[6] ..... B44C 5/02

[52] U.S. Cl. ..... 40/158.1; 40/152

[58] Field of Search ..... 40/152, 152.1, 154, 40/158.1, 159

[56] References Cited

U.S. PATENT DOCUMENTS

| | | | |
|---|---|---|---|
| 1,464,447 | 8/1923 | Shrachka et al. | 40/152 |
| 2,496,008 | 1/1950 | Jablon | 40/159 |
| 2,697,889 | 12/1954 | Heim | 40/152 |
| 2,799,107 | 7/1957 | McArthur | 40/159 |
| 5,130,825 | 7/1992 | Kok-Schram De Jong | 40/152 X |

*Primary Examiner*—Brian K. Green
*Attorney, Agent, or Firm*—Kenneth A. Roddy

[57] ABSTRACT

A picture frame arrangement for installation in picture frames. The arrangement includes a planar mat board having a first picture viewing opening, a thin transparent film secured to the back surface of the mat board and covering the mat board picture viewing opening, and at least one planar spacer board having a second picture viewing opening. The spacer board is installed against the front surface of the picture or printed material to be viewed and the mat board with the transparent film on the back surface thereof is installed against the front surface of the spacer board such that the transparent film is disposed in parallel spaced relation to the picture or printed material to be viewed through the first and second picture viewing openings. In one embodiment, the thin transparent film has an image imprinted thereon which is visible in the foreground of the picture or printed material to give a three-dimensional effect and may include indicia depicting an event related to the picture or printed material installed in the picture frame. Another embodiment has first and second spacer boards wherein the mat board and the first spacer board are spaced apart to form a pocket which receives a removable stiff transparent film member.

4 Claims, 5 Drawing Sheets

PICTURE FRAME ARRANGEMENT

CROSS-REFERENCE TO RELATED APPLICATION

This application is a divisional application of U.S. patent application Ser. No. 07/935,791, filed Aug. 27, 1992, now abandoned.

BACKGROUND OF THE INVENTION

1. Field of the Invention

This invention relates generally to picture frames, and more particularly to a picture frame arrangement utilizing a transparent overlay sheet bearing an image spaced from a background photograph, picture, or other printed matter mounted in the same frame.

2. Brief Description of the Prior Art

There are several patents which disclose various picture framing arrangements.

Pearlman, U.S. Pat. No. 3,283,431 discloses a picture frame assembly which permits the observation of the front and back surfaces of a picture postcard or the like.

Scheyer, U.S. Pat. No. 3,868,283 discloses a composite frame assembly which has a deep frame structure which encloses a thick composite picture made from a number of copies of a photograph having a background, middle ground and foreground subject matter built up in layers to provide a three dimensional effect.

Storch et al, U.S. Pat. No. 3,916,549 discloses a picture frame arrangement wherein a decorative member is held within the periphery of a supporting member to impart a floating appearance to the decorative member.

Kanzelberger, U.S. Pat. No. 4,384,416 discloses a picture frame assembly utilizing a transparent carrier panel and a bracket affixed to the back of the panel for retaining a picture, and a mat may be applied to the panel to block out or frame a portion of the picture to be displayed.

Cliborn, U.S. Pat. No. 4,860,468 discloses a windowed display for displaying baseball cards and flat objects that has a front panel having a matrix of cutouts smaller than the object to be displayed, an intermediate panel having a matrix of cutouts lager than the cutouts on the front panel, and a rear panel having a matrix of slots wider and shorter than the cutouts on the intermediate panel through which the objects to be displayed are inserted.

Sloot, U.S. Pat. No. 4,934,078 discloses a planar picture frame formed of vinyl materials that are bonded together and includes a front transparent vinyl sheet bearing an opaque printing defining a window surrounded by an opaque border placed over an inner layer of cardboard parts. One part is sized to fit under the opaque border while the other parts are so spaced as to define a support stand when folded.

French Patent 2,639,204 shows a free-standing picture frame having a planar front member, a transparent plastic plate and a planar back plate having slots. Wire legs are pivotally mounted in the slots in the back plate and their ends are captured between the back plate and an intermediate plate which has an opening and serves as a mat board.

The present invention is distinguished over the prior art in general, and these .patents in particular by a picture frame arrangement for installation in picture frames which includes a planar mat board having a first picture viewing opening, a thin transparent film secured to the back surface of the mat board and covering the mat board picture viewing opening, and at least one planar spacer board having a second picture viewing opening. The spacer board is installed against the front surface of the picture or printed material to be viewed and the mat board with the transparent film on the back surface thereof is installed against the front surface of the spacer board such that the transparent film is disposed in parallel spaced relation to the picture or printed material to be viewed through the first and second picture viewing openings. In one embodiment, the thin transparent film has an image imprinted thereon which is visible in the foreground of the picture or printed material to give a three-dimensional effect and may include indicia depicting an event related to the picture or printed material installed in the picture frame. Another embodiment has first and second spacer boards wherein the mat board and the first spacer board are spaced apart to form a pocket which receives a removable stiff transparent film member.

SUMMARY OF THE INVENTION

It is therefore an object of the present invention to provide a picture frame arrangement which is easily and quickly installed in existing picture frames.

It is another object of this invention to provide a picture frame arrangement which has a transparent film bearing an image superimposed a distance in front of the focal plane of a photograph, picture, illustration, or other printed matter to create a three-dimensional effect which compliments the object of the photograph, picture, illustration, or other printed matter.

Another object of this invention is to provide a picture frame arrangement which has a transparent film bearing an image superimposed a distance in front of the focal plane of a photograph, picture, illustration, or other printed matter to create a three-dimensional effect which compliments the object of the photograph, picture, illustration, or other printed matter, wherein the image on the transparent sheet has a direct relationship to the object of the photograph, picture, illustration, or other printed matter.

Another object of this invention is to provide a picture frame arrangement which has a removable transparent film bearing an image superimposed a distance in front of the focal plane of a photograph, picture, illustration, or other printed matter to create a three-dimensional effect which compliments the object of the photograph, picture, illustration, or other printed matter, and wherein the transparent sheet bearing the image may be swapped out from time to time.

Another object of this invention is to provide a picture frame arrangement which has a transparent film bearing an image superimposed a distance in front of the focal plane of a photograph, picture, illustration, or other printed matter to create a three-dimensional effect which compliments the object of the photograph, picture, illustration, or other printed matter, wherein the photograph, etc. and/or transparent sheet bearing an image may be selectively chosen to personalize the picture assembly for a particular person.

Another object of this invention is to provide a picture frame arrangement which has a pocket formed behind a mat board which allows quick and easy replacement of photographs, pictures, illustration, or other printed matter.

A further object of this invention is to provide a picture frame arrangement which has a pocket formed behind a mat board and a slot at the rear of the assembly which allows quick and easy replacement of photographs, pictures, illustration, or other printed matter.

A still further object of this invention is to provide a picture frame arrangement which is simple in construction and economical to manufacture.

Other objects of the invention will become apparent from time to time throughout the specification and claims as hereinafter related.

The above noted objects and other objects of the invention are accomplished by a picture frame arrangement for installation in picture frames which includes a planar mat board having a first picture viewing opening, a thin transparent film secured to the back surface of the mat board and covering the mat board picture viewing opening, and at least one planar spacer board having a second picture viewing opening. The spacer board is installed against the front surface of the picture or printed material to be viewed and the mat board with the transparent film on the back surface thereof is installed against the front surface of the spacer board such that the transparent film is disposed in parallel spaced relation to the picture or printed material to be viewed through the first and second picture viewing openings. In one embodiment, the thin transparent film has an image imprinted thereon which is visible in the foreground of the picture or printed material to give a three-dimensional effect and may include indicia depicting an event related to the picture or printed material installed in the picture frame. Another embodiment has first and second spacer boards wherein the mat board and the first spacer board are spaced apart to form a pocket which receives a removable stiff transparent film member.

DESCRIPTION OF THE PREFERRED EMBODIMENT

Figure 1:
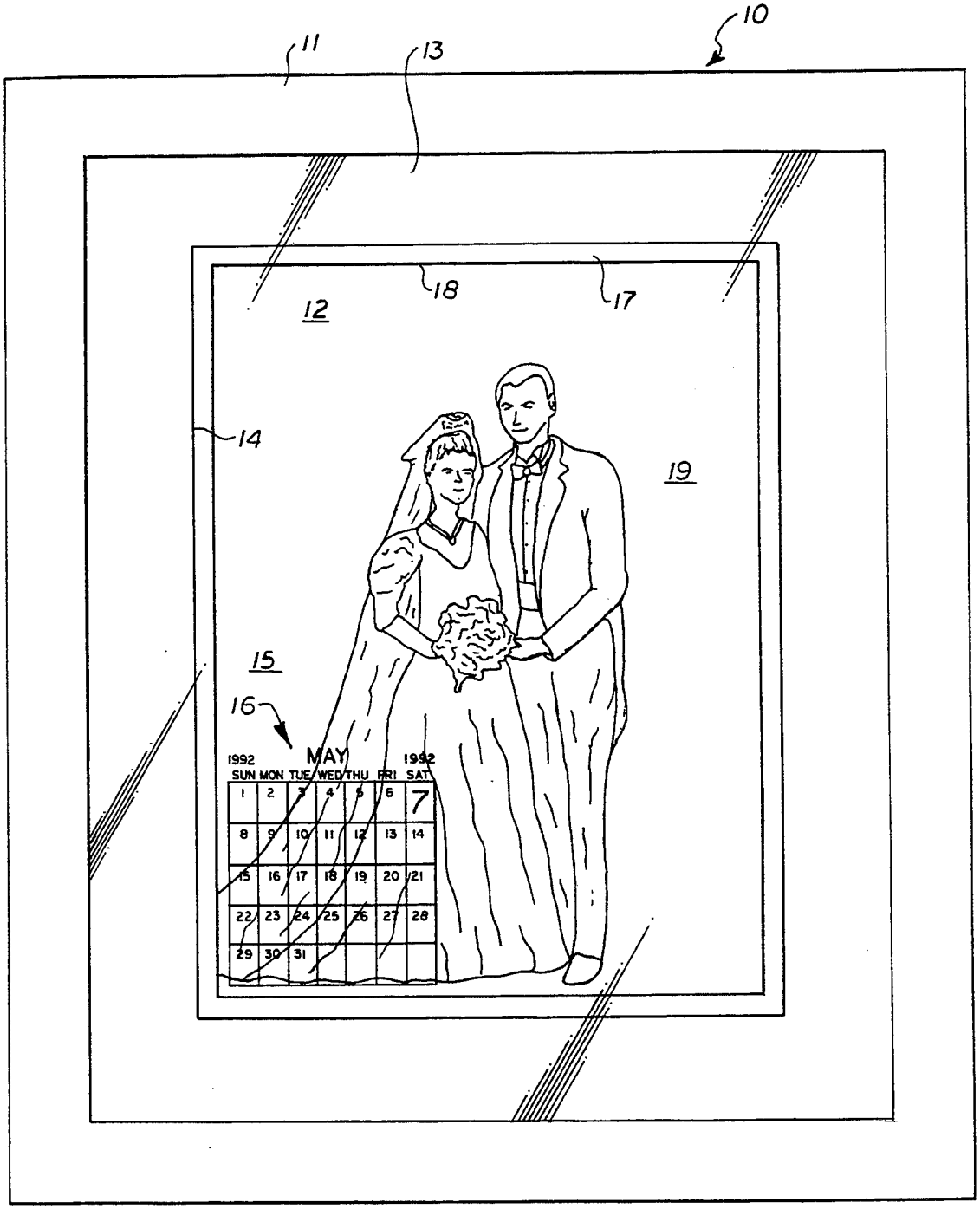
FIG. 1 is a front elevation view of a picture frame assembly created with the picture frame arrangement in accordance with the present invention.
Figure 3:
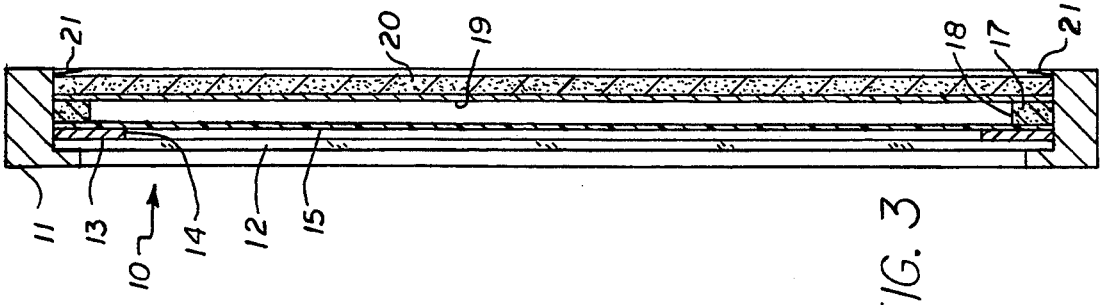
FIG. 3 is a longitudinal cross section of the picture frame arrangement of FIG. 1 in an assembled condition.
Figure 2:
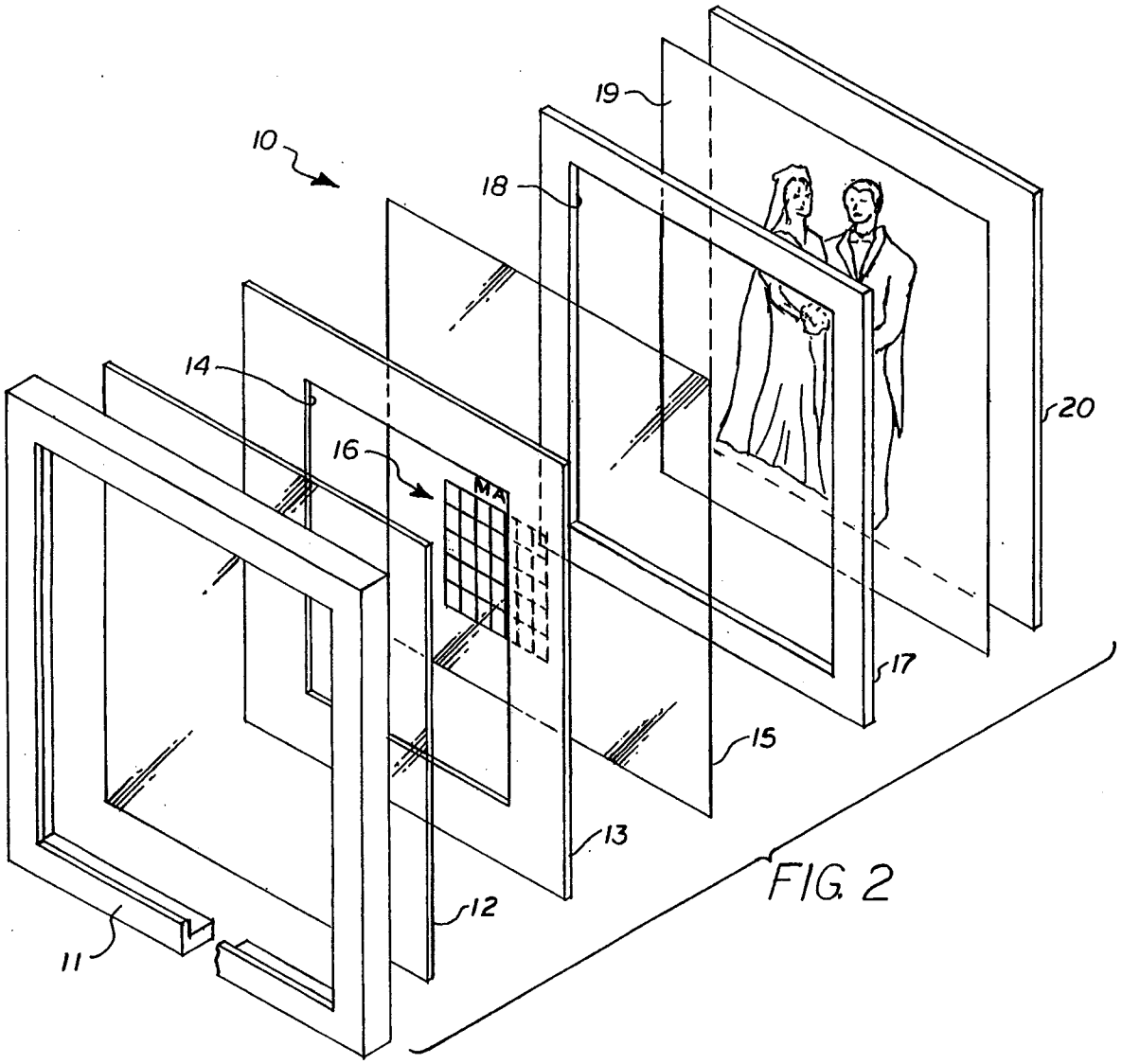
FIG. 2 is an exploded isometric view of the components of the picture frame arrangement of FIG. 1 shown in an unassembled condition.

Referring to the drawings by numerals of reference, there is shown in FIGS. 1, 2, and 3, a picture frame assembly 10 created with one embodiment of the picture frame arrangement in accordance with the present invention. The components of the picture frame assembly 10 are shown in an unassembled condition in FIG. 2. The picture frame assembly 10 utilizes a conventional picture frame 11 of the type having a central opening surrounded by a peripheral frame which is generally Lshaped in cross section and into which a rigid plate of transparent plastic or glass 12 is received in the usual manner. The present frame arrangement may also be used in other types of picture frames.

A decorative mat board 13 having a central opening 14 is installed in the frame 11 against the rear surface of the plastic or glass plate 12. A thin transparent sheet 15 is secured to the back side of the mat board 13. The transparent sheet 15 is preferably formed of clear plastic material, such as acetate. The sheet 15 has an image 16 printed thereon, preferably near one corner. The transparent sheet 15 is positioned such that the image 16 will be visible within the opening 14 of the mat board 13 and is secured to the back side of the mat board with a suitable adhesive, double sided tape, or other conventional means.

A stiff planar spacer board 17 having an outer periphery approximately the same size as the mat board 13 and a central opening 18 is installed in the frame 11 against the rear surface of the mat board 13. The central opening 18 of the spacer board 17 may be the same size or larger than the opening 14 of the mat board 13, or may be smaller to be visible through the opening of the mat board 13, in which case its front surface may be colored to complement whole assembly. The preferred thickness of the spacer board 17 would be in the range of from about $\frac{1}{8}''$ to $\frac{1}{4}''$. A preferred material for the spacer board is cardboard, fiberboard, or a plastic foam material known as "Foam-Core".

A photograph, picture, illustration, or other printed matter 19 is installed in the frame 11 against the rear surface of the spacer board 17. A stiff planar backing board 20 is installed in the frame against the back side of the photograph, picture, illustration, or other printed matter 19. A suitable backing board material is a plastic foam material known as "Foam-Core". The photograph, picture, illustration, or other printed matter 19 may be mounted on the front surface of the backing board 20 with a suitable adhesive or other conventional means and installed as a single unit.

After the plastic or glass plate 12, the mat board 13 with transparent sheet 15, the spacer board 17, the photograph, picture, illustration, or other printed matter 19, and backing board 20 have been assembled into the frame 11, suitable fasteners 21, such as brads, staples or other conventional fasteners are secured to the back side of the frame to maintain the components in the assembled condition (FIG. 3). A paper backing or cover (not shown) may also be secured over the back of the frame 11 to prevent moisture and debris from entering the small gap between the inner sides of the frame and the periphery of the backing board 20.

When the assembly has been completed, as seen in FIG. 1, the photograph, picture, illustration, or other printed matter 19 serves as the focal point. The image 16 on the transparent sheet 15 is superimposed a spaced distance in front of the focal plane of the picture 19 and seen in the foreground to create a three-dimensional effect to complement the object of the photograph, picture, illustration, or other printed matter. In the preferred embodiment, the image 16 on the transparent sheet 15 has a direct relationship to the object of the photograph, picture, illustration, or other printed matter 19. For example, as illustrated, the photograph 19 is a wedding photograph and the image 16 on the sheet 15 is a calendar showing the year, month, and date, of the wedding to commemorate the event.

Referring now to FIGS. 4 through 8, there is shown another embodiment of a picture frame arrangement 30 which incorporates a removable transparent sheet. The components of the picture frame arrangement 30 are shown in an unassembled condition in FIG. 5. The picture frame arrangement 30 utilizes a conventional picture frame member 11 into which a rigid plate of transparent plastic or glass 12 is received as described previously.

A decorative mat board 31 with a central opening 32 has a sheet of thin clear or transparent plastic film 33 secured to the back surface of the mat board to cover the central opening. The film 33 is secured by a suitable adhesive or tape. The film 33 presents a smooth surface on the back side of the mat board 31 and serves as a guide, as explained hereinafter. The mat board 31 with the transparent film 33 on the back surface is installed in the frame 11 against the rear surface of the plastic or glass plate 12.

A first U-shaped stiff planar spacer board 34 has a central opening 35 with three sides 34A, 34B, and 34C. The width and height of the spacer board 34 is approximately the same width and height as the mat board 31. The spacer board 34 is installed in the frame 11 against the rear surface of the mat board 31. The central opening 35 of the spacer board 34 is larger than the central opening 32 of the mat board 31 so that it cannot be seen when the assembly is viewed from the front. The preferred thickness of the first spacer board 34 would be in the range of from about 1/16" to ⅛".

A second U-shaped stiff planar spacer board 36 has a central opening 37 with three sides 36A, 36B, and 36C. The width of the second spacer board 36 is approximately the same width as the first spacer board 34, but the height of the second spacer board 36 is shorter than the height of the first spacer board 34. The second spacer board 36 is installed in the frame 11 against the rear surface of the first spacer board 34. The opening 37 of the second spacer board 36 is approximately the same size or smaller than the central opening 32 of the mat board 31 but smaller than the opening 35 in the first spacer board 34. The front surface of the second spacer board 36 may be colored to complement the whole assembly. The preferred thickness of the second spacer board 36 would be in the range of from about ⅛" to ¼".

The mat board 31 with the film 33 on the back surface and the first and second spacer boards 34 and 36 may be secured together with a suitable adhesive or double sided tape and installed in the frame 11 against the rear surface of the plastic or glass plate 12 as a single unit.

When assembled, the mat board 31 and second spacer board 36 are spaced apart by the first spacer 34 therebetween. Thus, an open top end pocket 38 is formed between the back surface of the mat board 31 with film 33 and the front surface of the second spacer 36. The sides 34A and 34B of the first spacer board 34 extend above the top of the sides 36A and 36B of the second spacer board 36 and serve as guide rails at each side of the pocket 38 and the bottom side 34C of the first spacer serves as the bottom of the pocket. The film 33 on the back surface of the mat board 31 provides a smooth slick transparent surface or wall on the front side of the pocket 38.

A photograph, picture, illustration, or other printed matter 19 is installed in the frame 11 against the rear surface of the second spacer board 36. A stiff planar backing board 20 is installed in the frame against the back side of the photograph, picture, illustration, or other printed matter 19. The photograph, picture, illustration, or other printed matter 19 may be mounted on the front surface of the backing board 20 with a suitable adhesive or other conventional means and installed as a single unit. The width and height of the backing board 20 and photograph, picture, illustration, or other printed matter 19 is approximately the same as the second spacer board 36 and larger than the opening 32 in the mat board 31 so that the photograph, picture, etc. is framed by the mat board 31 when viewed from the front.

A thin stiff transparent sheet 39 is slidably received in the pocket 38 formed between the back surface of the mat board 31 with film 33 and the front surface of the second spacer board 36. The width of the transparent sheet 15 is slightly smaller than the distance between the sides 34A and 34B of the first spacer 34 and its height is greater than the opening 37 in the second spacer board 26. The sides 34A and 34B of the first spacer board 34 extending above the top of the sides 36A and 36E of the second spacer 36 serve as guide rails on each side of the pocket 38 for insertion and removal of the transparent sheet 39 and the bottom side 34A of the first spacer board serves as the support surface for supporting the sheet 39. The film 33 on the back surface of the mat board 31 provides a smooth slick surface to facilitate insertion and removal of the transparent sheet 39 and prevents it from getting caught in the opening 32 of the mat board 31 during insertion. Since the height of the transparent sheet 15 is greater than the height of the opening 37 in the second spacer board 36 and the backing board 20, its upper edge will extend above the pocket 38 so that it can be gripped by the fingers to remove it.

The transparent sheet 39 is formed of clear plastic material, such as acetate and has an image 40 printed thereon. The transparent sheet 39 is positioned within the pocket 38 such that the image 40 will be visible within the opening 32 of the mat board 31.

After the plastic or glass plate 12, the mat board 31 with film 33, the first and second spacer boards 34 and 36, the photograph, picture, illustration, or other printed matter 19, and backing board 20 have been assembled into the frame 11, suitable fasteners 21, such as brads, staples or other conventional fasteners are secured to the back side of the frame 11 to maintain the components in the assembled condition. A paper flap or cover (not shown) may also be secured over the open top end of the backing board 20 to prevent moisture and debris from entering.

Figure 4:
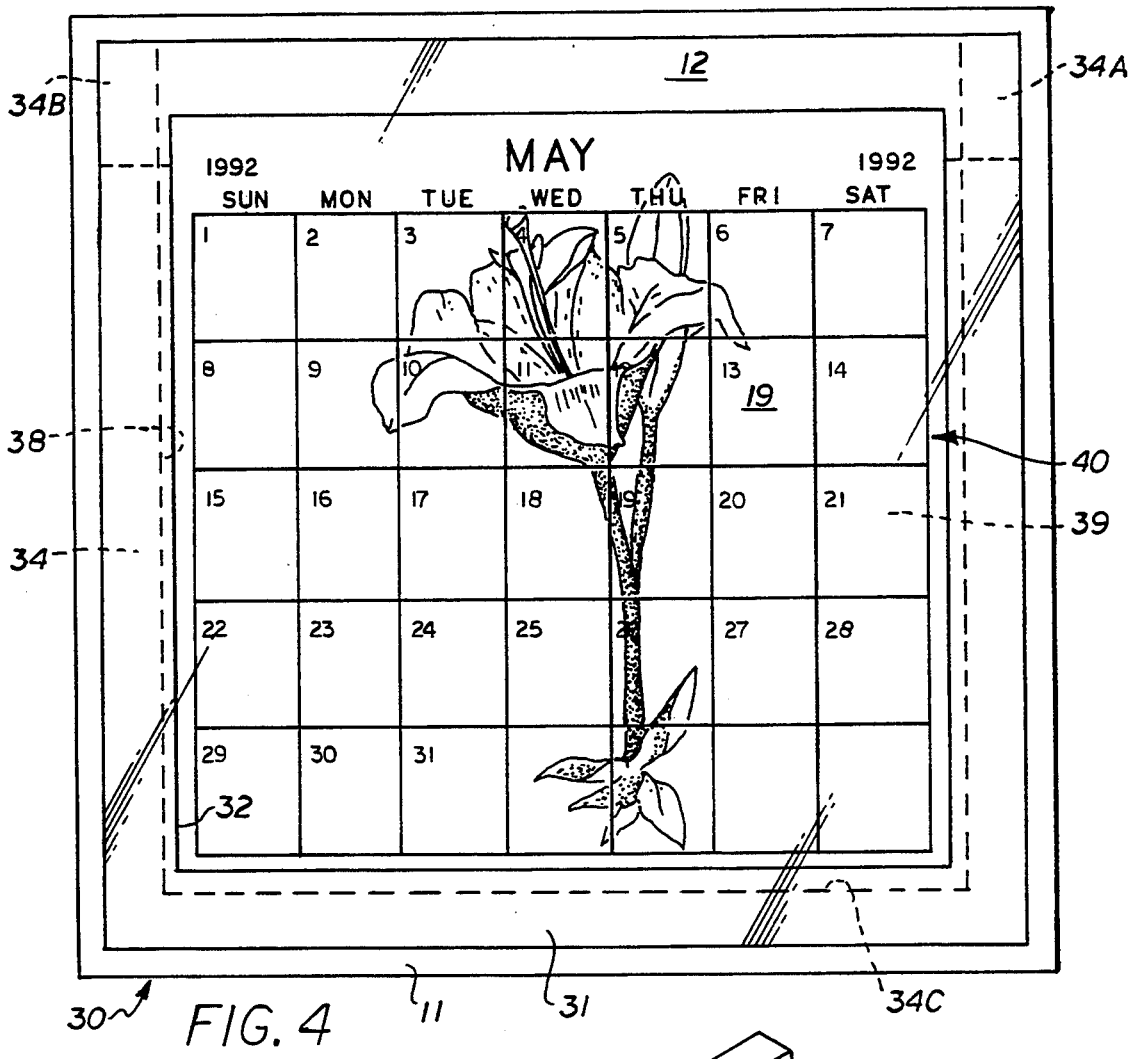
FIG. 4 is a front elevation view of another picture frame assembly created with the picture frame arrangement in accordance with the present invention.
Figure 8:
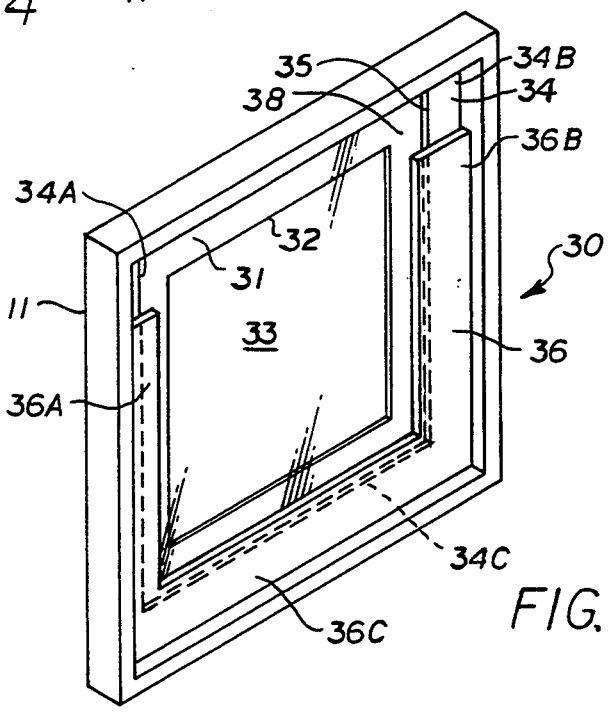
FIG. 8 is an isometric view of the back side of the picture frame arrangement of FIG. 4 in a partially assembled condition.
Figure 6:
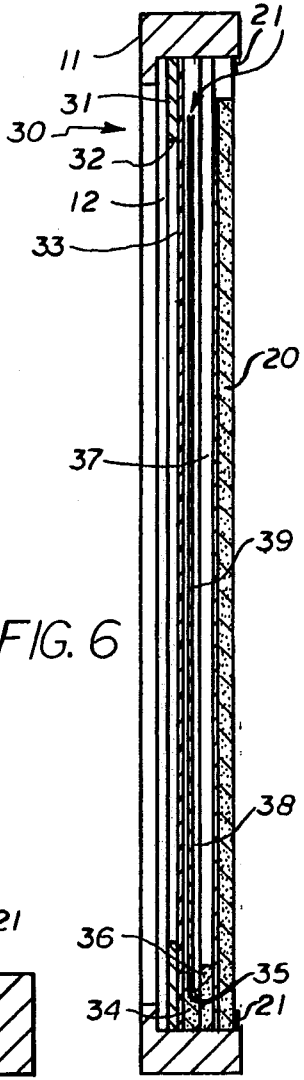
FIG. 6 is a longitudinal cross section of the picture frame arrangement of FIG. 4 in an assembled condition.
Figure 5:
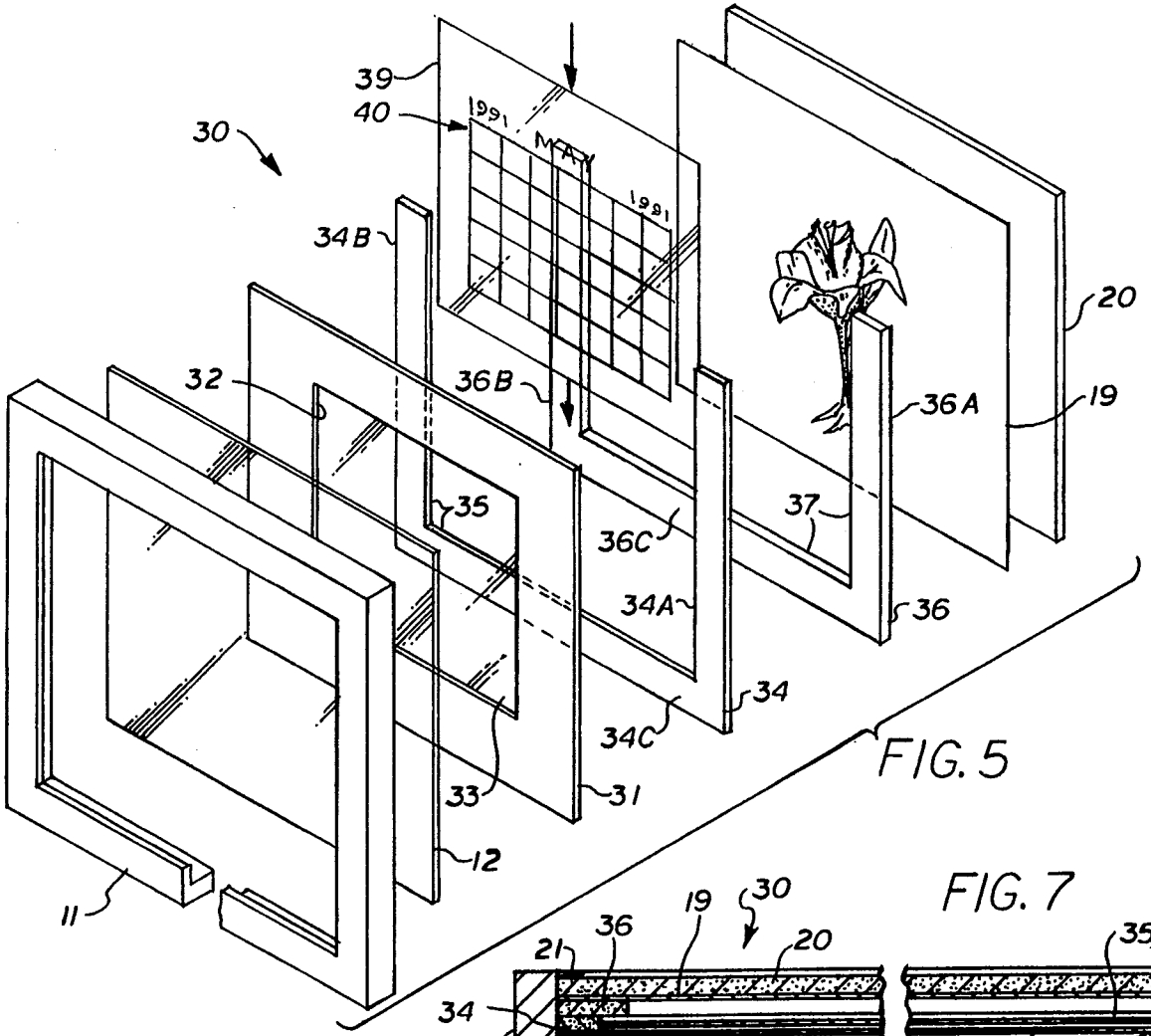
FIG. 5 is an exploded isometric view of the components of the picture frame arrangement of FIG. 4 shown in an unassembled condition.
Figure 7:
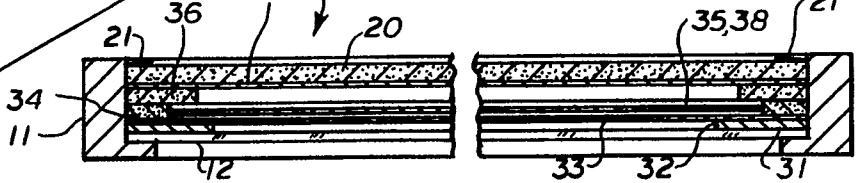
FIG. 7 is a transverse cross section of the picture frame arrangement of FIG. 4 in an assembled condition.

When the assembly has been completed, as seen in FIG. 4, the photograph, picture, illustration, or other printed matter 19 serves as the focal point. The image 40 on the transparent sheet 39 is superimposed a spaced distance in front of the focal plane of the picture 19 and seen in the foreground to create a three-dimensional effect to complement the object of the photograph, picture, illustration, or other printed matter. In embodiment of FIG. 4, the photograph, picture, illustration, or other printed matter 19 remains in the frame, and the transparent sheet 39 bearing the image 40 may be swapped out from time to time, or to personalize the picture assembly for a particular recipient. For example, as illustrated, the picture 19 is a flower arrangement and the image 40 on the transparent sheet 39 is a calendar which may be changed each month. The image 40 may also be a personalized message, poem, etc. for a particular person and the picture, etc. may be representative of that person's hobby or occupation. Thus, a customer could select a suitable picture and an transparent sheet 39 bearing a suitable image or message and have them assembled to provide a customized picture display for a particular person.

Figure 11:
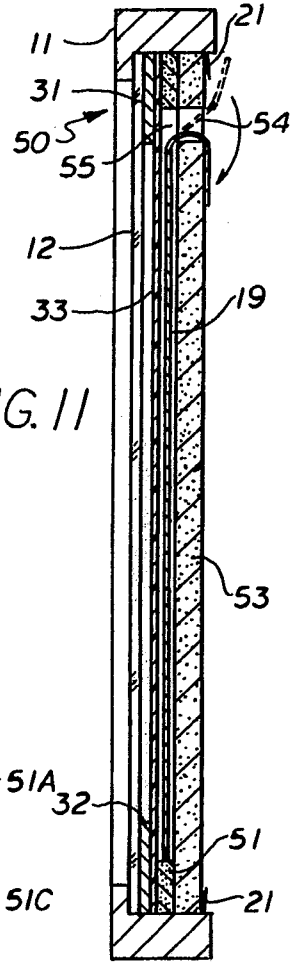
FIG. 11 is a longitudinal cross section of the picture frame arrangement of FIG. 9 in an assembled condition.
Figure 9:
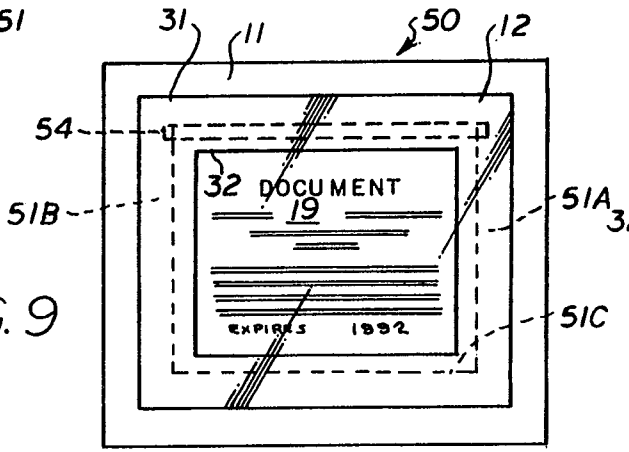
FIG. 9 is a front elevation view of another picture frame assembly created with the picture frame arrangement in accordance with the present invention.
Figure 10:
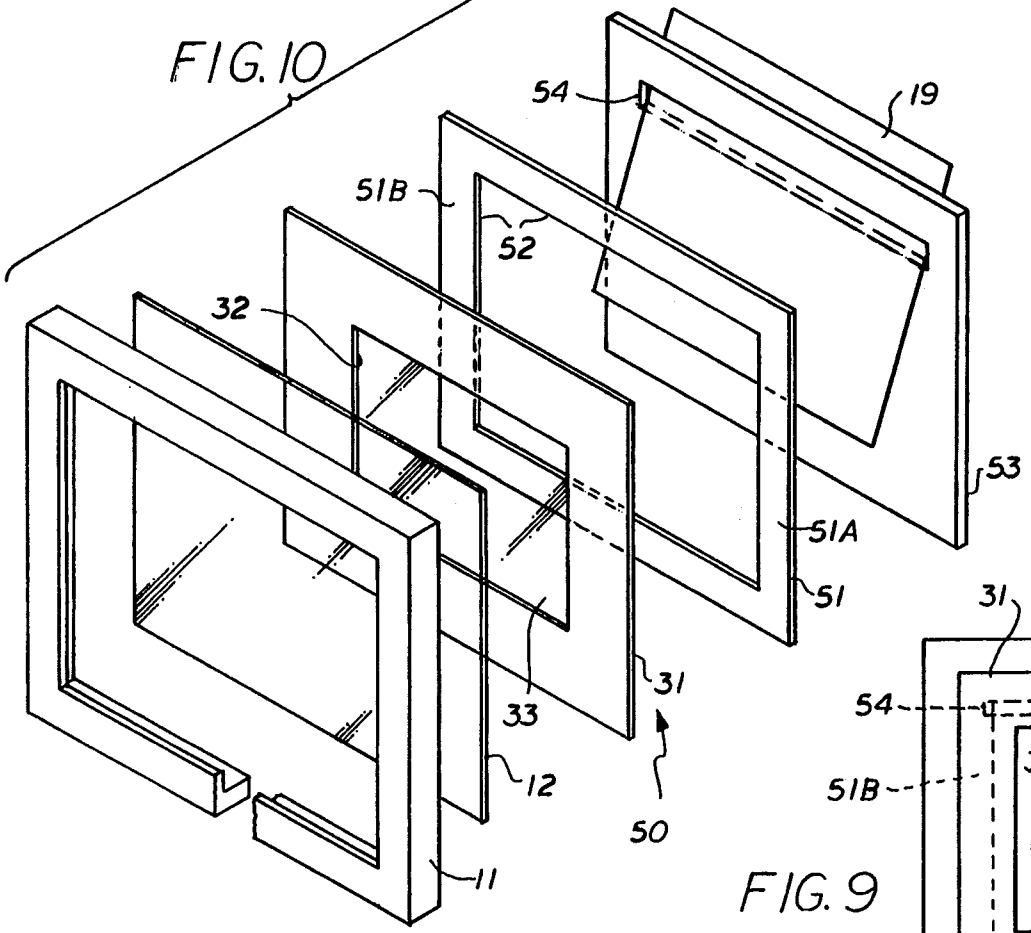
FIG. 10 is an exploded isometric view of the components of the picture frame arrangement of FIG. 9 shown in an unassembled condition.

Referring now to FIGS. 9, 10, and 11, another embodiment of the picture frame arrangement 50 is described which is useful for dated documents, certificates, etc. which require periodic replacement. The components of the picture frame arrangement 50 are shown in an unassembled condition in FIG. 10. The picture frame arrangement 50 also utilizes a conventional picture frame member 11 into which a rigid plate of transparent plastic or glass 12 is received as previously described.

A decorative mat board 31 with a central opening 32 has a sheet of thin clear or transparent plastic film 33 secured to the back surface of the mat board to cover the opening. The film 33 is secured by a suitable adhesive or tape. The film 33 presents a smooth surface on the back side of the mat board 31 and serves as a guide, as explained hereinafter. The mat board 31 with the film 33 on the back surface is installed in the frame 11 against the rear surface of the plastic or glass plate 12.

A stiff planar spacer board 51 has a central opening 52 and a width and height approximately the same as the mat board 31 and is installed in the frame 11 against the rear surface of the mat board 31. The opening 52 of the spacer board 51 is larger than the central opening 32 of the mat board 31 so that it cannot be seen when the assembly is viewed from the front. The preferred thickness of the spacer board 51 would be in the range of from 1/16" to ⅛".

A stiff planar backing board 53 is installed in the frame 11 against the back side of the spacer board 51. The backing board 53 has a slot 54 extending transversly from side to side. The 54 slot is located to be above the opening 32 in the mat board 31 so that is not visible when the assembly is viewed from the front. The mat board 31 with the film 33 on the back surface, the spacer board 51, and the backing board 53 may be secured together with a suitable adhesive or double sided tape and installed in the frame 11 against the rear surface of the plastic or glass plate 12 as a single unit.

As best seen in FIG. 11, when assembled, the mat board 31 and backing board 53 are spaced apart by the spacer board 51 such that the opening 52 of the spacer board forms a pocket 55 between the back surface of the mat board 31 with film 33 and the front surface of the backing board 53. The slot 54 in the backing board 53 is disposed near the upper end of the pocket 55. The lateral sides 51A and 51B of the spacer board 51 serve as guide rails at each side of the pocket 55 and the bottom side 51C of the spacer board serves as the bottom of the pocket. The film 33 on the back surface of the mat board 31 provides a smooth slick transparent surface or front wall for the pocket 55.

After the plastic or glass plate 12, the mat board 31 with film 33, the spacer board 51, and backing board 53 have been assembled into the frame 11, suitable fasteners 21, such as brads, staples or other conventional fasteners are secured to the back side of the frame to maintain the components in the assembled condition.

A certificate, document, etc. 19 is slidably received through the slot 54 in the backing board 53 and into the pocket 55 formed between the back surface of the mat board 31 with film 33 and the front surface of the backing board. The width of the document 19 is slightly smaller than the distance between the sides 51A and 51B of the spacer board 51 and the slot 54. The height of the document 19 is such that its top edge will extend outwardly from the slot 54 in the backing board 53. The sides 51A and 51B of the spacer board 51 serve as guide rails on each side of the pocket for insertion and removal of the document 19 and the bottom side 51C of the spacer board serves as the support surface for supporting the document 19. The film 33 on the back surface of the mat board 31 provides a smooth slick surface to facilitate insertion and removal of the document 19 and prevents it from getting caught in the opening 32 of the mat board 31 during insertion. The document 19 is positioned within the pocket 55 such that it will be visible within the opening 32 of the mat board 31. Since the top edge of the document 19 extends outwardly from the slot 54, it can be gripped by the fingers to remove it. The top edge of the document 19 may also be folded over to reside flat against the back surface of the backing board 53. A paper flap or cover (not shown) may also be secured over the slot 54 and top portion of the document 19 to prevent moisture and debris from entering through the slot. While this invention has been described fully and completely with special emphasis upon several preferred embodiments, it should be understood that within the scope of the appended claims the invention may be practiced otherwise than as specifically described herein.

I claim:

1. A picture framing arrangement comprising in combination:

a picture frame having a peripheral frame defining an opening with a recessed ledge-shaped surface on its back side surrounding the opening;

a transparent plate having front and back surfaces installed within said ledge-shaped surface of said picture frame;

a planar mat board having front and back surfaces received within said ledge-shaped surface of said picture frame behind said transparent plate, and having an opening surrounded by side portions of said mat board defining a first picture viewing opening;

a thin transparent film secured to the back surface of said mat board and covering said mat board first picture viewing opening, said thin transparent film having a first image imprinted thereon positioned within said first picture viewing opening;

at least one planar spacer board of predetermined thickness having front and back surfaces received within said ledge-shaped surface of said picture frame and having an opening surrounded by side portions of said spacer board defining a second picture viewing opening;

a picture or flat printed material installed within said ledge-shaped surface of said picture frame behind said at least one spacer board and having a second image imprinted thereon positioned within said second picture viewing opening; and said at least one spacer board being of sufficient thickness to space said transparent film a distance in front of said said picture or printed material such that said first image and said second image have different focal planes and produce a three-dimensional effect when a viewer focuses their eyes on said second image imprinted on said picture or printed material.

2. The picture framing arrangement according to claim 1 in which said first image imprinted on said thin transparent film includes indicia depicting an event related to said second image imprinted on said picture or printed material.

3. The picture frame arrangement according to claim 1 in which said first image imprinted on said thin transparent film is a calendar.

4. The picture framing arrangement according to claim 1 wherein said mat board, said thin transparent film with said first image imprinted thereon, and said at least one spacer board are secured together to form a single unit of sandwich construction and are removably received in said ledge-shaped surface of said picture frame as a single unit with said at least one spacer board back surface disposed against said picture or printed material and said thin transparent film with said first image imprinted thereon disposed in parallel spaced relation to said picture or printed material.

* * * * *